US005913321A

United States Patent [19]

Yung

[11] Patent Number: 5,913,321

[45] Date of Patent: Jun. 22, 1999

[54] ONE-HANDED CONTROL STICK UMBRELLA

[76] Inventor: Kwong Y Yung, 30 Gwizdak Ct., Sayreville, N.J. 08872

[21] Appl. No.: 08/952,191

[22] PCT Filed: Apr. 30, 1996

[86] PCT No.: PCT/CN96/00029

§ 371 Date: Nov. 7, 1997

§ 102(e) Date: Nov. 7, 1997

[87] PCT Pub. No.: WO96/35347

PCT Pub. Date: Nov. 14, 1996

[30] Foreign Application Priority Data

May 9, 1995 [CN] China ..... 95211861

[51] Int. Cl.[6] ..... A45B 25/14; A45B 19/04

[52] U.S. Cl. ..... 135/24; 135/20.3; 135/31

[58] Field of Search ..... 135/24, 20.3, 31

[56] References Cited

U.S. PATENT DOCUMENTS

| | | | |
|---|---|---|---|
| 2,405,044 | 7/1946 | Montalvo . | |
| 3,746,025 | 7/1973 | Murata . | |
| 3,756,258 | 9/1973 | Yoshihara . | |
| 3,796,226 | 3/1974 | Yuen | 135/24 |
| 4,685,482 | 8/1987 | Yung | 135/24 |
| 4,977,913 | 12/1990 | Meyman | 135/24 |

*Primary Examiner*—Christopher Kent
*Attorney, Agent, or Firm*—Fulbright & Jaworski, LLP.

[57] ABSTRACT

A stick umbrella capable of being opened and closed by one hand having a stem, a crown, a runner, main ribs, and stretchers constituting a frame; an elongated slide which is slidably arranged along the stem and carries at the upper end a notch member to which the struts pivoted to the stretchers are pivotally connected; a lever pivotally attached at one end to a collar which is attached to the lower end of the elongated slide and at the other end to the outer end of a radius rod, the inner end of the radius rod is pivoted to a handle, a compression spring being arranged between the crown and the notch for closing the umbrella, and another compression spring arranged between the runner and the lower end of the elongated slide for slightly opening the umbrella when the latch on the cloth is unfastened.

8 Claims, 2 Drawing Sheets

ONE-HANDED CONTROL STICK UMBRELLA

BACKGROUND OF THE INVENTION

The present invention relates to an umbrella, particularly to a stick umbrella which can both be opened and closed by one hand and, more particularly, to an umbrella which has a stem, a crown, a runner, main ribs, and stretchers and makes use of an operating principal described in my U.S. Pat. No. 3,796,226 to constitute a stick umbrella which can both be opened and closed by one hand.

FIELD OF THE INVENTION

When opening a stick umbrella which has a one-handed operating mechanism at the bottom of a stem including those operating mechanism described in U.S. Pat. No. 3,796,226, the movement by the swing of the fingers or by the squeeze of the palm is much shorter than the movement of the runner towards the crown required for the opening of a conventional stick umbrella, so that the stretchers must be pivoted to the main ribs sufficiently near to the crown in order to correspondingly reduce the movement of the runner towards the crown required for opening the umbrella.

If the pivot points are very near to the crown the umbrella would easily be overtilt by strong wind, or the construction of the umbrella frame must be more complicated to guarantee that the umbrella is wind-proof but a more complicated umbrella frame would increase the cost of the umbrella.

SUMMARY OF THE INVENTION

A main object of the invention Is to provide a one-handed control stick umbrella of simple construction which is economical to manufacture and is wind-proof.

Another object of the invention is to provide a one-handed control stick umbrella which is more easily and less strenuously to open.

An umbrella according to the present invention comprises a stem which is connected at its top end to a crown pivotally supporting the ribs. A runner is slidable along the stem and pivotally supports the stretchers. The outer ends of the stretchers are pivoted to the main ribs intermediate the ends of the main ribs. A slide is slidable along the stem and carries at its upper end a notch member which pivotally supports the struts and is movable between the crown and the runner. The outer ends of the struts are pivoted to the stretchers near to their pivot points with the main ribs. A provided one-handed control mechanism fixed at the bottom of the stem.

According to one embodiment of the present invention, a collar is attatched to the lower end of the slide. A link is pivoted to the collar at one end and at the other end to the outer end of a radius rod. The other end of the radius rod is pivoted to a handle fixed at the bottom of the stem.

The present invention can make use of the operating principal described in U.S. Pat. No. 3,796,226.

For operation by one hand, the thumb of the hand holding the umbrella is placed on the outer end of the radius rod while other fingers are gripping the stem and the handle, the radius rod is squeezed to open the umbrella, to close the umbrella, all fingers transfer to grip the radius rod and pull it away from the stem, the umbrella will be closed by a compression spring arranged between the crown and the notch member, the compression spring may be obviated and the umbrella can be opened and closed by its own weight, when the umbrella is held tip downward it will be opened under the influence of gravity, when the umbrella is held tip upward it will be closed under the influence of gravity, and the umbrella is operated as previously described.

Since the outer ends of the stretchers are pivoted to the main ribs intermediate the ends thereof but not near to the crown and the outer ends of the struts are pivoted to the stretchers near to their outer ends, the rigidity of the umbrella is increased to guarantee that the umbrella is wind-proof.

DETAILED DESCRIPTION OF THE INVENTION

Embodiments of the Invention are illustrated by way of example in the accompanying drawings.

Figure 1:
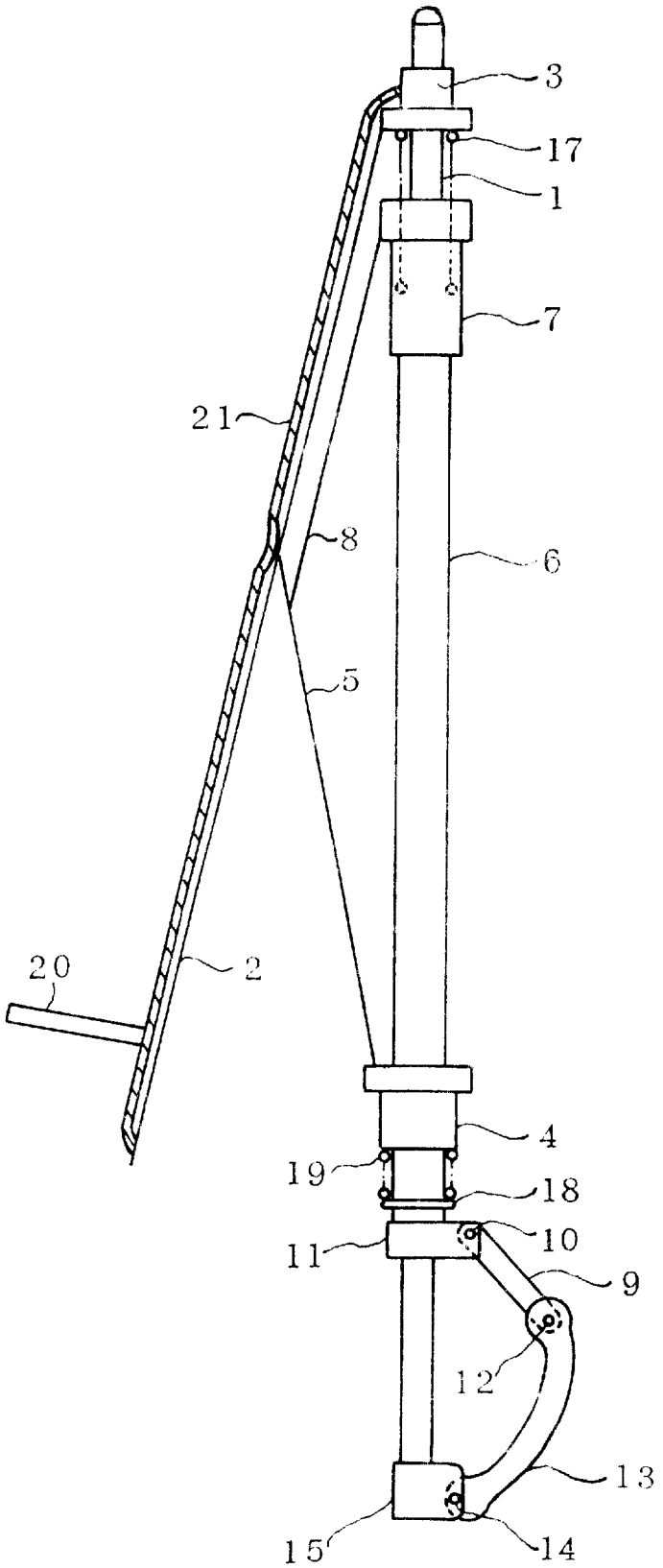
FIG. 1 shows one embodiment of umbrella in the closed position.
Figure 2:
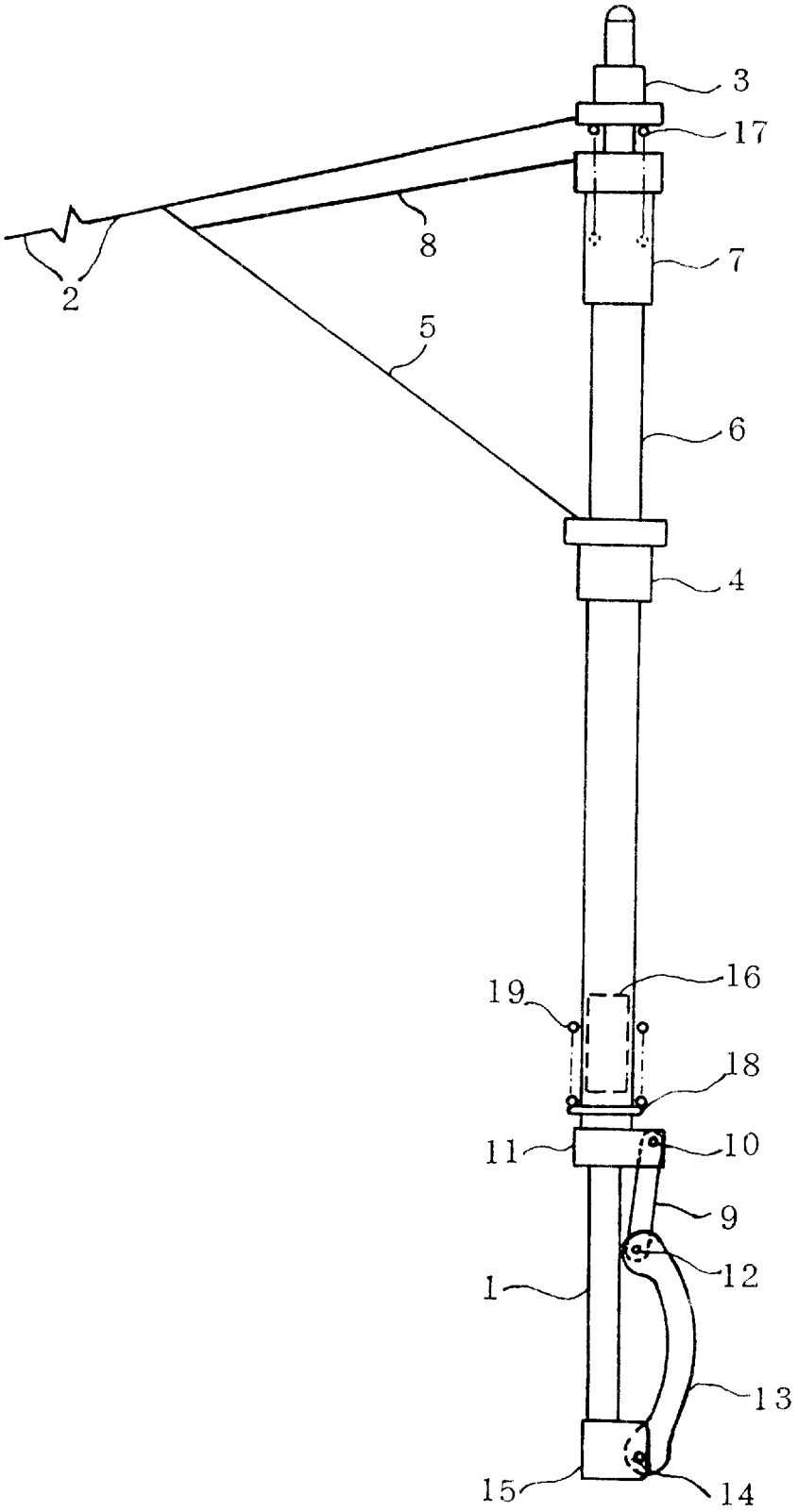
FIG.2 shows the umbrella in an open position.

Referring to FIG. 1 to FIG. 2, the umbrella shown comprises a crown (3) which is connected at the top of a stem (1) and pivotally supports the inner ends of the main ribs (2). A runner (4) is slidably attached along the stem (1) and pivotally supports the inner ends of the stretchers (5). The outer ends of the stretchers (5) are pivotally connected to the main ribs (2) intermediate the ends thereof. A tubular elongated slide (6) is slidably arranged within the runner (4) and around the stem (1), and carries at its upper end a notch member (7) which moves between the crown (3) and the runner (4) and pivotally supports the inner ends of the struts (8). The outer ends of struts (8) are pivotally connected to stretchers (5) near to their pivot points with main ribs (2) at a distance no longer than 1.5 inches (38.1 mm) from the pivot point to the outer end of the stretcher (5).

On sliding movement of the elongated slide (6) between the runner (4) and the stem (1) the umbrella is opened and closed. The outer ends of the stretchers (5) are pivoted to the main ribs (2) intermediate the ends thereof and the stretchers (5) are retained by the struts (8) in a desired position to lock the runner. Thus the umbrella is guaranteed wind-proof.

According to one embodiment of the present invention the one-handed control operating mechanism includes a link (9) which is pivoted by one of its end at point (10) to a collar (11) attached to the lower end of the tubular elongated slide (6) and at its other end at point (12) to the outer end of the radius rod (13). The other end of the radius rod (13) is pivoted at point (14) to handle (15) which is fixed at the bottom of the stem (1). The internal diameter of the tubular elongated slide (6) is larger than the external diameter of the stem (1) A sleeve (16) is secured inside the tubular elongated slide (6) serving as a bushing in order to reduce friction.

The internal diameter of the upper portion of the notch member (7) is larger than the internal diameter of the lower portion. A compression spring (17) is arranged and accommodated between the notch member (7) and the crown (3) for closing the umbrella.

An outwardly flanged tip (18) is provided at the bottom of the elongated slide (6). A compression spring (19) is arranged between the outwardly flanged tip (18) and the runner (4) for slightly opening the umbrella when the umbrella is in the closed position.

A latch (20) is provided on the cover (21) which is attached to the main ribs (2). When the latch is fastened the compression spring (19) is compressed and the umbrella will be in the closed position in conventional manner. When the latch is unfastened the umbrella will be slightly opened but it is still in closed position, the user will continue to open the umbrella. It is less strenuous to open a partially opened umbrella. Thus the umbrella is opened and closed from time to time.

To open the umbrella while other fingers are holding the stem (1) and the handle (15), the thumb is placed on the outer end of the radius rod (13), the radius rod (13) is squeezed until its outer end rests on the stem (1), and the compression spring (17) is compressed. When the umbrella is in the open position and the outer end of the radius rod (13) to which the link (9) is pivoted rests on the stem (1), the pivot point (12) is between the axis of the stem (1) and a straight line from pivot point (10) to pivot point (14), so that the force exerted by spring (17) and the tensioned cover moves the collar (11) downward to make pivot point (12) rest on stem (1) to lock the umbrella in the open position. To close the umbrella the hand transfers to grip the radius rod (13) and pulls it away from the stem (1) transversely of the axis of the stem (1), when the pivot point (12) crosses the straight line from the pivot point (10) to pivot point (14) the compression spring (17) will bias the notch member (7) to close the umbrella. The spring (17) may be obviated, if the umbrella is held tip upward it will be closed by its own weight under the influence of gravity and if the umbrella is held tip downward it will be opened by its own weight under the influence of gravity. The umbrella is operated as previously described.

According to one embodiment of the present invention the stretcher is rigid, the inner part of the main rib from the inner end to the neighboring section of the pivot point may be rigid and the outer part of the main rib from the outer end to the neighboring section of the pivot point is flexible. When the umbrella is in the open position the tensioned cover will bend the outer part of the main rib.

It will be understood that the specification and example are illustrated but not limitative of the present invention and that other embodiments within the spirit and scope of the invention will suggest themselves to those skilled in the art, for example the embodiments described in U.S. Pat. No. 3,796,226.

I claim:

1. A stick umbrella for being operated by one hand, said umbrella comprising:

a crown (3) connected at the top of a stem (1) and pivotally supporting main ribs (2);

a runner (4) slidable along said stem (1) and pivotally supporting stretchers (5);

the outer ends of said stretchers (5) being pivoted to said main ribs (2) intermediate the ends of said main ribs (2);

a slide (6) slidable along said stem (1) and carrying at the upper end a notch member (7);

said notch member (7) being movable between said crown (3) and said runner (4), and pivotally supporting struts (8);

the outer ends of said struts (8) being pivoted to said stretchers (5) near to said outer ends of said stretchers (5); and a one-handed control operating mechanism fixed at the bottom of said stem (1) for displacing said slide (6).

2. An umbrella as claimed in claim 1 and further comprising: a collar (11) attached to the bottom of said slide (6); a handle (15) fixed at the bottom of said stem (1); a link (9) at one end pivotally connected to said collar (11); a radius rod (13) pivotally connected at one end to the other end of said link (9) and connected at the other end to said handle (15) for constituting said one-handed control operating mechanism.

3. An umbrella as claimed in claim 1 wherein said slide (6) is a tube slidably arranged within said runner (4) and around said stem (1).

4. An umbrella as claimed in claim 2 wherein said slide (6) is a tube slidably arranged within said runner (4) and around said stem (1).

5. An umbrella as claimed in claim 1 wherein said outer end of each of said struts (8) is pivoted to said stretchers (5) at a distance no greater than 38.1 mm from the pivot point to said outer end of said stretcher (5).

6. An umbrella as claimed in claim 2 wherein said outer end of each of said struts (8) is pivoted to said stretchers (5) at a distance no greater than 38.1 mm from the pivot point to said outer end of said stretcher (5).

7. An umbrella as claimed in claim 1, and further comprising a compression spring (17) arranged between said crown (3) and said notch member (7).

8. An umbrella as claimed in claim 2, and further comprising a compression spring (17) arranged between said crown (3) and said notch member (7).

* * * * *